United States Patent [19]

Beghin

[11] 4,090,553

[45] May 23, 1978

[54] INTERNALLY COOLED ROLL

[75] Inventor: Marcel Beghin, Lille, France

[73] Assignee: Fives-Cail Babcock, Paris, France

[21] Appl. No.: 767,247

[22] Filed: Feb. 10, 1977

[30] Foreign Application Priority Data

Feb. 18, 1976 France ..... 76 04400

[51] Int. Cl.[2] ..... B22D 11/12; B22D 11/124; B21B 27/06; F28F 5/02

[52] U.S. Cl. ..... 164/448; 164/443; 165/89; 72/201; 29/110

[58] Field of Search ..... 164/282, 283 M; 72/200, 72/201, 236; 29/110, 113 R, 125; 165/89, 90; 249/79, 80, 81

[56] References Cited

U.S. PATENT DOCUMENTS

| | | | |
|---|---|---|---|
| 1,651,502 | 12/1927 | Banbury | 165/89 |
| 1,900,556 | 3/1933 | Hitchcock | 165/89 |
| 2,902,774 | 9/1959 | Swaney | 165/89 X |
| 2,908,486 | 10/1959 | Thornburg | 72/200 X |
| 3,100,631 | 8/1963 | Schmidt | 165/89 |
| 3,282,332 | 11/1966 | Burdick | 165/89 |
| 3,965,974 | 6/1976 | Sernetz | 165/89 |

*Primary Examiner*—Francis S. Husar
*Assistant Examiner*—John S. Brown
*Attorney, Agent, or Firm*—Kurt Kelman

[57] ABSTRACT

An internally cooled roll comprises a cylindrical body having two trunnions and an axially extending internal chamber. A coaxial cylindrical lining is countersunk in the chamber by casting and a coaxial hollow cylinder is arranged within the lining. The lining and cylinder define therebetween a passage for circulating a cooling fluid therethrough. Two conduits respectively supply and remove the cooling fluid to and from the passage, one of the conduits being connected with the lining.

9 Claims, 3 Drawing Figures

INTERNALLY COOLED ROLL

The present invention relates to improvements in internally cooled rolls, particularly rolls used in continuous metal casting installations wherein a freshly molded metal strip or ingot is removed from the mold through a roll-rack comprised of a series of cooled guide rolls.

Continuous metal casting installations of this type as well known, as shown, for instance, in U.S. Pat. No. 3,763,923, dated Oct. 9, 1973. It has been found advantageous to cool such rolls internally, and internally cooled rolls are well known.

It is the primary object of this invention to provide an internally cooled roll of simple structure and which may be produced economically.

This and other objects are accomplished in accordance with the invention with an internally cooled roll which comprises a cylindrical body having an axis and two trunnions, the body defining an axially extending chamber in the interior thereof. A cylindrical lining is countersunk in the chamber by casting and is coaxial with the cylindrical body. A coaxial cylinder is arranged within the lining, the lining and cylinder defining therebetween a passage extending in the direction of the axis for circulating a cooling fluid therethrough. First conduit means for supplies the cooling fluid to the passage and second conduit means removes the fluid therefrom, one of the conduit means being connected with the cylindrical lining.

The above and other objects, advantages and features of the present invention will become more apparent from the following detailed description of now preferred embodiments thereof, taken in conjunction with the accompanying drawing wherein FIG. 1 is a longitudinal axial section of one embodiment of an internally cooled roll according to this invention;

Figure 1:
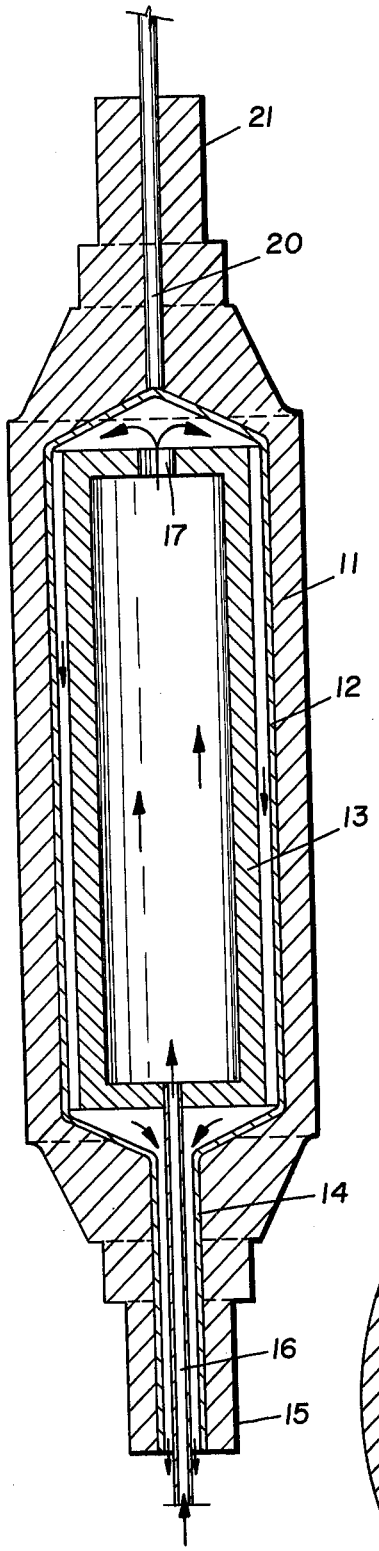

Referring now to the drawing and first to FIG. 1, there is shown an internally cooled roll which comprises cylindrical body 11 having two coaxial trunnions 15 and 21. The body defines an axially extending chamber in the interior thereof. Cylindrical metal lining 12 is embedded in cylindrical body 11, the lining being countersunk in the chamber of the cylindrical body by casting and being coaxial with the cylindrical body. Coaxial hollow cylinder 13 is arranged within the lining. This cylinder is preferably a thin-walled cast iron body. The lining 12 and cylinder 13 define therebetween a passage extending in the direction of the axis of the roll for circulating a cooling fluid therethrough.

Conduit means for supplying the cooling fluid to the internal conduit and for removing the fluid therefrom is shown in the embodiment of FIG. 1 to comprise metallic tube 14 passing through an axial bore in trunnion 15 and being connected with cylindrical lining 12 with which it is countersunk in the chamber of cylindrical body 11. Another metallic tube 16 of smaller diameter is arranged coaxially within tube 14 and is attached to one end of cylinder 13, leading into the hollow interior thereof. the opposite end of cylinder 13 defines port 17.

Figure 3:
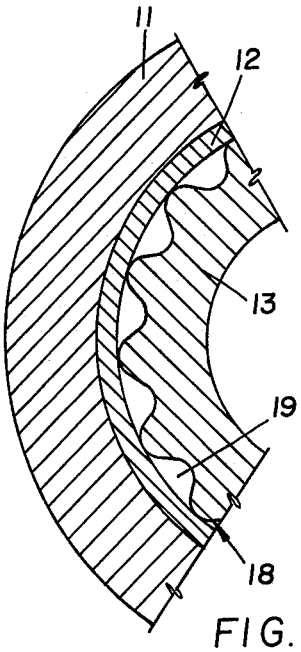
FIG. 3 is a partial transverse section showing one detail of a roll according to either embodiment.

As shown in FIG. 3, the external wall of hollow cylinder 13 has channels 18 constituted by longitudinal grooves extending in an axial direction from one end of the cylinder to the other. In the illustrated embodiment, the grooves extend about the entire circumference of the hollow cylinder and their apices are in contact with the internal wall of cylindrical lining 12 to define therewith a plurality of passages 19.

As indicated by the arrows in FIG. 1, cooling fluid is supplied to the internal passage in the roll through a first conduit constituted by tube 16 whence it passes into the hollow interior of cylinder 13, through port 17 and passages 19, and is removed through a second conduit constituted by the annular conduit defined between tubes 14 and 16.

An axially extending centering rod 20 passes through trunnion 21 of the roll and is affixed to the end of cylindrical lining 12 opposite to the end integral with tube 14, the lining being countersunk in the chamber of cylindrical body 11 with rod 20 when the lining is cast, another centering element being formed by tube 16. After casting, the portion of the centering rod extending beyond the trunnion is cut off.

Figure 2:
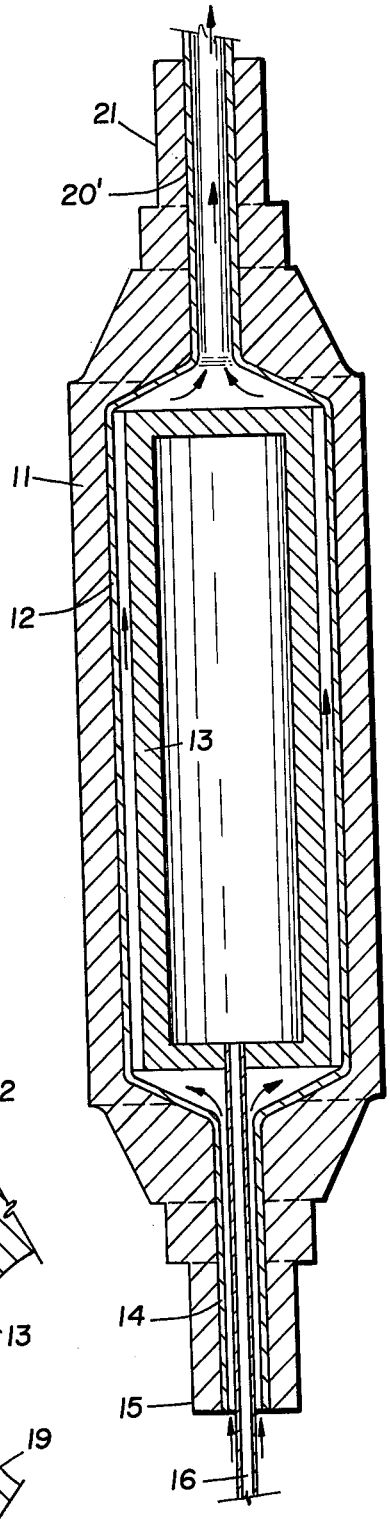
FIG. 2 is a like view of another embodiment.

To avoid redundancy in the description, the same reference numerals designate like parts functioning in a like manner in the embodiment of FIG. 2. Only those features differing from the first-described embodiment will be described in connection with this figure.

As shown, hollow cylinder 13 has no port and tube 16 constitutes merely a centering element during casting which may either be entirely removed by detaching it from cylinder 13 after casting or whose portion extending beyond trunnion 15 is cut off after casting. A second centering element is constituted by axially extending tube 20' integral with an end of lining 12 opposite to trunnion 15. Tube 20' passes through an axial bore in trunnion 21 and is affixed to lining 12, the lining being countersunk in the chamber of cylindrical body 11 with tube 20' when the lining is cast. The external wall of cylinder 13 may be formed in the manner of FIG. 3 or the longitudinal passages in either embodiment may be replaced by helically extending passages.

As shown by the arrows in FIG. 2, cooling fluid is supplied to the internal passage through a second conduit constituted by the annular conduit defined between tubes 14 and 16 or, if tube 16 is removed after casting, simply through tube 14 whence it passes through the passages between cylinder 13 and lining 12, and is removed through a second conduit constituted by tube 20'. Obviously, the direction of fluid circulation may be reversed, i.e. the fluid may flow in through tube 20' and flow out through tube 14.

While two embodiments have been illustrated, various modifications may occur to those skilled in the art without departing from the spirit and scope of this invention as defined in the appended claims. Thus, for instance, in the embodiment of FIG. 2, centering elements may be formed at each end of the roll by ends of tubes 14 and 20' extending during casting beyond the trunnions, or by a projecting tube 16 and a similar projecting tube mounted in the interior of tube 20'.

The manufacturing process of the cooled roll is explained below in reference to FIG. 1.

At first, the cylinder 13 is cast and the tube 16 is fixed to said cylinder. This tube constitutes a first centering element. Next, the cylinder 13 with its tube 16 is lodged in the cylindrical lining 12. The cylindrical lining 12 is only provided with a first bottom equipped with the tube 14 disposed around the tube 16. The cylindrical lining 12 is supported by the apices of the grooves formed in the cylinder 13. Further, a second bottom provided with the rod 20 is fixed by welding on the cylindrical lining 12. The rod 20 constitutes a second centering element. The assembled parts are anchored by the tube 16 to a casting mold. The annular space between the tubes 14 and 16 is filled with not agglomerated sand. The mold is filled with molten metal to form the body 11 of the roll. The mass of the cylinder 13 being sufficiently important, the temperature of said cylinder do not exceeds 1,300° F before the metal of the body 11 is wholly solidified in the mold.

I claim:

1. An internally cooled roll comprising (a) a cylindrical body having an axis and two trunnions, the body defining an axially extending chamber in the interior thereof, (b) a cylindrical lining countersunk in the chamber by casting and coaxial with the cylindrical body, (c) a coaxial hollow cylinder arranged within the lining, the lining and cylinder defining therebetween a passage extending in the direction of the axis for circulating a cooling fluid therethrough, and (d) a first conduit means for supplying said cooling fluid to said passage and a second conduit means for removing the fluid therefrom, at least one of the conduit means being connected with the cylindrical lining.

2. The internally cooled roll of claim 1, wherein the other conduit means is connected with the hollow cylinder.

3. The internally cooled roll of claim 1, wherein the hollow cylinder is a thin-walled cast iron body.

4. The internally cooled roll of claim 1, further comprising an axially extending centering element at least at one end of the cylindrical lining.

5. The internally cooled roll of claim 4, wherein at least one of the centering elements is a tube constituting the conduit means for supplying or removing the fluid.

6. The internally cooled roll of claim 1, further comprising an axially extending centering element at least at one end of the hollow cylinder.

7. The internally cooled roll of claim 6, wherein at least one of the centering elements is a tube constituting the conduit means for supplying or removing the fluid.

8. The internally cooled roll of claim 1, wherein the external wall of the hollow cylinder has channels defining with the internal wall of the cylindrical lining a plurality of passages between the lining and cylinder.

9. The internally cooled roll of claim 8, wherein the channels are longitudinal grooves in the external wall of the hollow cylinder extending in an axial direction.

* * * * *